United States Patent [19]

Litkewycz

[11] 4,348,014

[45] Sep. 7, 1982

[54] TORSION BAR SPRING AUXILIARY PANEL FOR BEDDING UNIT

[75] Inventor: Stanley Litkewycz, Brighton, Mich.

[73] Assignee: Lear Siegler, Inc., Berkley, Mich.

[21] Appl. No.: 157,131

[22] Filed: Jun. 6, 1980

[51] Int. Cl.[3] ..... A47C 25/00; A47C 23/30; F16F 13/00

[52] U.S. Cl. ..... 267/87; 5/260; 5/267

[58] Field of Search ..... 5/246, 248, 260, 261, 5/267, 268, 475, 476; 267/87

[56] References Cited

U.S. PATENT DOCUMENTS

| | | | |
|---|---|---|---|
| 2,280,912 | 4/1942 | Hopkes | 5/267 |
| 2,383,157 | 8/1945 | Pink | 5/267 |
| 2,729,830 | 1/1956 | Gleason | 267/87 |
| 2,870,823 | 1/1959 | Staples | 5/260 |
| 3,242,505 | 3/1966 | Tyhanic | 5/475 |
| 3,475,016 | 10/1969 | Wahlman' | 267/87 |
| 3,840,915 | 10/1974 | Simon | 5/246 |
| 4,180,877 | 1/1980 | Higgins | 5/267 |

*Primary Examiner*—Alexander Grosz

*Attorney, Agent, or Firm*—Reising, Ethington, Barnard, Perry & Brooks

[57] ABSTRACT

An auxiliary panel (12) for a bedding unit (10) is disclosed as including a peripheral wire (24) on the load supporting surface of the unit and a plurality of torsion bar springs (30 or 42) extending between opposite portions of the peripheral wire so as to resiliently provide increased firmness. Distal end torsion bars of each torsion bar spring are connected to the peripheral wire to provide the cooperation therebetween during use. Different embodiments of the panel incorporate sinuous wire type springs (30) and formed wire type springs (42) extending both longitudinally between opposite longitudinal portions (26) of the peripheral wire as well as laterally between opposite lateral portions (28) of the peripheral wire.

8 Claims, 6 Drawing Figures

TORSION BAR SPRING AUXILIARY PANEL FOR BEDDING UNIT

TECHNICAL FIELD

This invention relates generally to bedding units such as mattresses or box springs and, more particularly, to an auxiliary panel for providing increased firmness to a bedding unit.

BACKGROUND ART

Bedding units such as mattresses and box springs conventionally include a plurality of springs defining a load supporting surface whose firmness is selected to suit needs and desires of the customer. For example, heavier people require a firmer unit than do lighter people so as to prevent excessive deflection. Also, different people of the same weight often desire a different firmness for most comfortable sleeping.

Greater firmness of bedding units can be achieved by increasing the diameter wire of the springs that define the load supporting surface. However, this necessarily results in a heavier unit as well as increased cost to the customer. Another way in which greater firmness can be achieved is by the use of an auxiliary panel on the load supporting surface in the central sleeping area at which the greater support is desired.

U.S. Pat. Nos. 3,242,505, 3,735,431 and 3,840,915 disclose bedding units having auxiliary panels for increasing firmness at the central sleeping area. Each of these panels includes straight wires whose ends are connected to a peripheral wire and whose intermediate portions are supported by the springs of the unit in order to provide cooperation of the springs of the unit in supporting any concentrated weight such as from the sleeper's chest or buttocks. During use, these straight wires are loaded in a bending mode and tend to pull the peripheral wire portions of the panel toward each other due to the manner of loading.

U.S. Pat. Nos. 2,383,157 and 4,122,566 disclose bedding unit auxiliary panels with open areas within their peripheral wires such that certain of the springs are not connected to the panels. As such, the degree to which firmness can be increased is limited in units having this type of auxiliary panel.

U.S. Pat. Nos. 2,280,912, 2,386,456 and 2,659,417 disclose spring units including torsion bar springs of one type utilized in accordance with the present invention in a particular way to provide an auxiliary support panel for a bedding unit.

DISCLOSURE OF INVENTION

An object of the present invention is to provide an improved auxiliary panel for providing increased firmness to the load supporting surface defined by springs of a bedding unit.

In carrying out the above object and other objects of the invention, the auxiliary panel includes a peripheral wire on the load supporting surface of the unit and a plurality of torsion bar springs extending between opposite portions of the peripheral wire so as to resiliently provide increased firmness to the unit. Each torsion bar spring has oppositely opening loops including torsion bars and connecting portions extending between the torsion bars such that loading of the bars in a torsion mode resiliently provides the increased firmness. Distal end torsion bars of each torsion bar spring are connected to the peripheral wire to provide the cooperation therebetween during use of the panel.

The peripheral wire of the auxiliary panel has a rectangular shape including longitudinal and lateral portions which extend parallel to a border wire that defines longitudinal and lateral margins of the load supporting surface on which the panel is utilized. Each of the longitudinal portions of the peripheral wire is spaced inwardly from the adjacent longitudinal margin defined by the border wire. Each of the lateral portions of the peripheral wire is also preferably spaced inwardly from the adjacent lateral margin defined by the border wire. However, in certain applications it may be desirable for the auxiliary panel to extend the full width of the unit such that the lateral portions of the peripheral wire thereof are positioned at the same location as the lateral margins defined by the border wire of the unit.

Two different types of torsion bar springs are disclosed for use with the auxiliary panel to provide increased firmness to the load supporting surface. Sinuous wire type springs disclosed include curved connecting portions extending between the torsion bars such that the oppositely opening loops of these springs have curved shapes at their closed ends. Formed wire type springs also disclosed have generally straight connecting portions extending between the torsion bars.

The auxiliary panel has particular utility when utilized with a mattress on which a sleeping person is directly supported. However, the auxiliary panel can also be utilized with box springs which are conventionally utilized to support mattresses. When utilized with a mattress, the auxiliary panel can be provided on only one side thereof so that different degrees of firmness can be selected by the consumer simply by turning the mattress to one side or the other. The same or varying degrees of firmness can also be provided on both sides of the mattress by providing two of the auxiliary panels respectively located on the opposite load supporting mattress surfaces. Also, the peripheral wire of the panel may be either bare or covered with paper or plastic, etc. in a conventional manner.

In one preferred embodiment of the auxiliary panel, the torsion bar springs utilized are of the sinuous wire type and extend between the longitudinal portions of the peripheral wire thereof spaced laterally from each other and from the lateral portions of the peripheral wire. The distal end torsion bars of these springs are connected to the longitudinal portions of the peripheral wire such that the sinuous wire springs and peripheral wire of the panel cooperate to provide the increased firmness to the load supporting surface of a unit with which the panel is utilized.

Another preferred embodiment of the auxiliary panel utilizes torsion bar springs of the sinuous wire type extending between the lateral portions of the peripheral wire spaced longitudinally from each other and from the longitudinal portions of the peripheral wire. Each of these laterally extending sinuous wire springs has distal end torsion bars connected to the lateral portions of the peripheral wire at appropriate longitudinal positions therealong such that the sinuous wire springs and the peripheral wire cooperate to provide increased firmness to the load supporting surface as desired along the longitudinal extent of the unit with which the panel is utilized.

Still another preferred embodiment of the auxiliary panel utilizes torsion bar springs of the formed wire type extending between longitudinal portions of the peripheral wire spaced laterally from each other and from the lateral portions of the peripheral wire. Each of these formed wire springs includes distal end torsion bars connected to the longitudinal portions of the peripheral wire such that the formed wire springs and peripheral wire of the panel cooperate to provide the increased firmness to the load supporting surface of a unit with which the panel is utilized.

Yet still another preferred embodiment of the auxiliary panel utilizes torsion bar springs of the formed wire type extending laterally between the lateral portions of the peripheral wire spaced longitudinally from each other and from the longitudinal portions of the peripheral wire. Each of the formed wire springs includes distal end torsion bars connected to the lateral portions of the peripheral wire at longitudinal positions therealong such that the auxiliary panel provides increased firmness to the load supporting surface as desired along the longitudinal extent of the unit with which the panel is utilized.

When utilized with a bedding unit of the single person size, only a single auxiliary panel will normally be utilized in a central position on each load supporting surface. However, when utilized with a bedding unit of the double, queen, or king size type, either one relatively wide auxiliary panel or a pair of narrower auxiliary panels appropriately positioned can be utilized.

The objects, features, and advantages of the present invention are readily apparent from the following detailed description of the best modes for practicing the invention when taken in connection with the accompanying drawings.

BEST MODES FOR CARRYING OUT THE INVENTION

Figure 1:
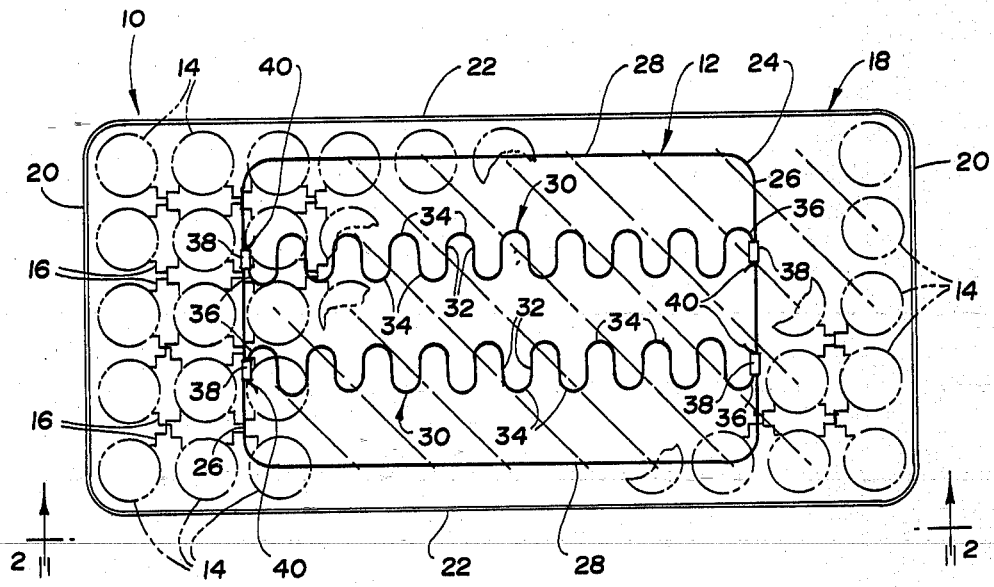
FIG. 1 is a top plan view of a bedding unit which incorporates one preferred embodiment of an auxiliary panel constructed in accordance with the present invention and utilizing longitudinally extending sinuous wire springs.

Referring to FIG. 1 of the drawings, a bedding unit embodied by a mattress 10 utilizes an auxiliary panel 12 constructed in accordance with the present invention in order to provide increased firmness at the sleeping area. Coil springs 14 of mattress 10 have ends which are connected by helical connector springs 16 so as to cooperatively provide a load supporting surface on which a sleeping person rests and at which the auxiliary panel 12 is utilized to provide increased firmness. A border wire 18 of a generally rectangular shape with rounded corners defines longitudinal and lateral margins 20 and 22, respectively, of the load supporting surface in a conventional fashion.

Auxiliary panel 12 illustrated in FIG. 1 includes a peripheral wire 24 of a generally rectangular shape carried by the load supporting surface defined by the ends of springs 14. Opposite longitudinal portions 26 of wire 24 are located inwardly from and extend parallel to the longitudinal margins 20 defined by border wire 18, while opposite lateral portions 28 of the peripheral wire are located laterally inward from the lateral margins 22 defined by the border wire in a parallel extending relationship. Torsion bar springs 30 of panel 12 are of the sinuous wire type and extend longitudinally between the longitudinal portions 26 of the peripheral wire 24 along the support surface defined by springs 14 in a laterally spaced relationship with respect to each other and with respect to the lateral portions 28 of the peripheral wire. Each spring 30 has oppositely opening loops including torsion bars 32 and curved connecting portions 34 extending between the torsion bars. Distal torsion bars 36 of each spring 30 are secured in any conventional manner such as by associated clips 38 to the peripheral wire at the adjacent longitudinal portions 26 such that the sinuous wire springs and the peripheral wire cooperate to provide increased firmness to the load supporting surface of mattress 10 during use. During loading, the sinuous wire springs 30 deflect in a torsional manner at their bars 32 so that concentrated loads can be carried while still spreading such loads over the entire area occupied by the panel. It will be noted that each of the distal torsion bars 36 includes a reverse bend so as to maintain the clip connection thereof to the peripheral wire.

Figure 2:
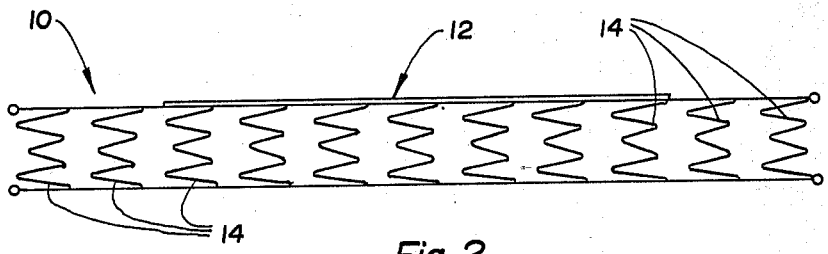
FIG. 2 is a side view of the bedding unit taken along line 2—2 of FIG. 1 to illustrate the auxiliary panel as being utilized on only one side of the unit.
Figure 3:
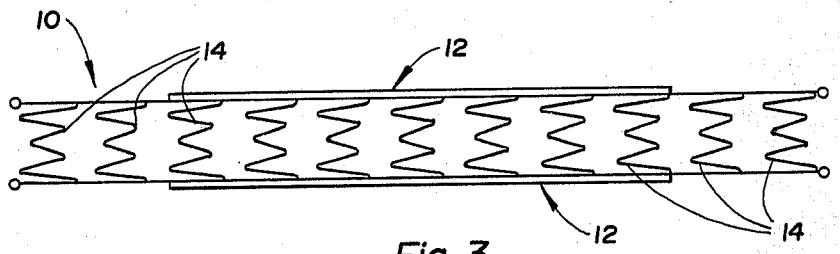
FIG. 3 is a side view similar to FIG. 2 but illustrating use of a pair of the auxiliary panels with one on each side of the bedding unit.

With reference to FIG. 2, the coil springs 14 of mattress 10 are illustrated as being of the hour-glass type such that both sides of the mattress define a load supporting surface. Auxiliary panel 12 is illustrated as being positioned on only one of the surfaces so that this one surface will be firmer than the other surface. Appropriate indicia on the cloth covering of the mattress can be provided so that the consumer will have an indication of which side should face upwardly for the degree of firmness desired. Also, as illustrated in FIG. 3, two auxiliary panels 12 can be utilized with one on each load supporting surface of the mattress so that the increased firmness of the same or varying extents will be provided on both surfaces.

Figure 4:
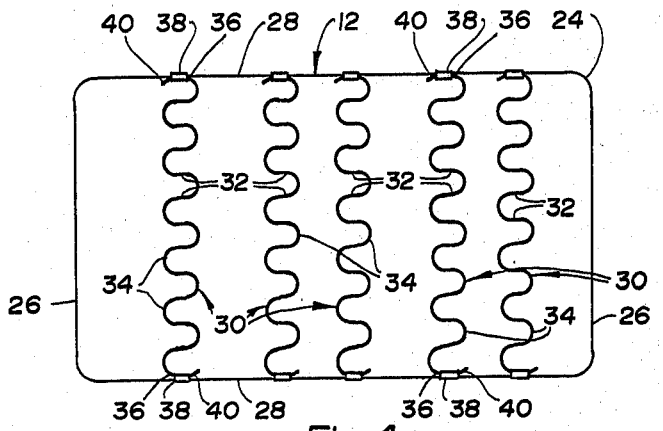
FIG. 4 is a plan view of another embodiment of the auxiliary panel which utilizes laterally extending sinuous wire springs.
Figure 5:
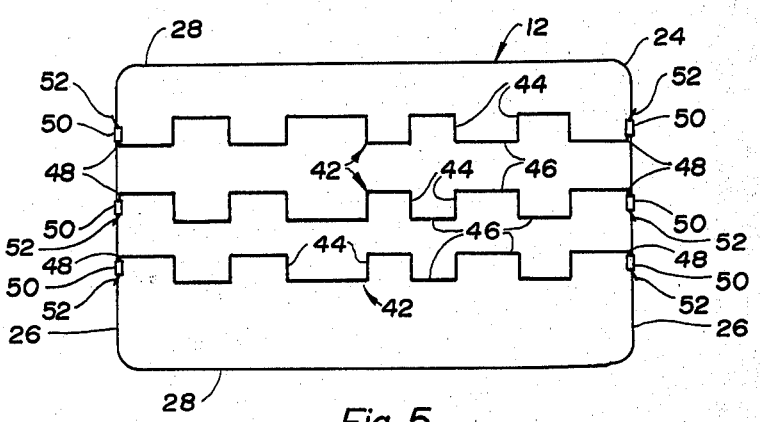
FIG. 5 is a plan view of another embodiment of the auxiliary panel which utilizes longitudinally extending formed wire springs.
Figure 6:
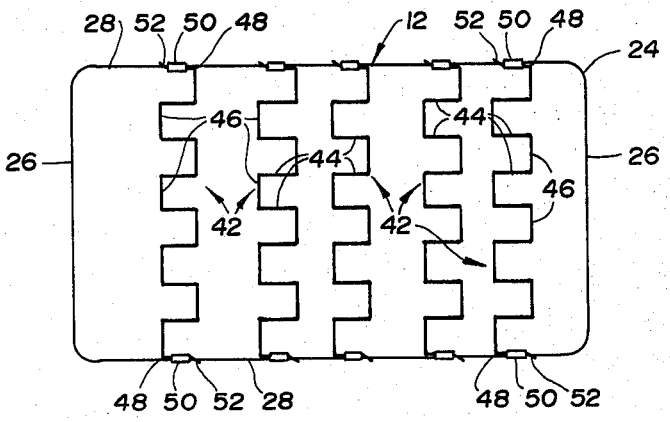
FIG. 6 is a plan view of another embodiment of the auxiliary panel which utilizes laterally extending formed wire springs.

FIGS. 4, 5, and 6 illustrate additional embodiments of the auxiliary panel 12 which are utilized with a bedding unit such as mattress 10 in the same manner as the embodiment described in connection with FIG. 1 and, as such, like reference numerals are applied to like components thereof and much of the previous description is applicable so that no repetition thereof is necessary.

The auxiliary panel 12 illustrated in FIG. 4 includes sinuous wire springs 30 extending between the lateral portions 28 of the peripheral wire 24 in a longitudinally spaced relationship with respect to each other and with respect to the longitudinal portions 26 of the peripheral wire. Torsion bars 32 and curved connecting portions 34 of these springs define oppositely opening loops thereof in the same manner as the previously described embodiment to provide torsional deflection upon loading during use. Distal torsion bars 36 of each spring 30 are connected by clips 38 to the lateral portion 28 of the peripheral wire at appropriate longitudinal positions so that the springs can provide the additional firmness at the desired location along the longitudinal extent of the mattress with which the panel is used. For example, the springs 30 may be positioned so as to provide increased support at the areas at which a sleeper's chest or buttocks are located or may be appropriately positioned so as to be in alignment with the coil springs of the mattress, etc.

Auxiliary panel 12 illustrated in FIG. 5 includes torsion bar springs 42 which are of the formed wire type extending between the longitudinal portions 26 of the peripheral wire 24 in a laterally spaced relationship with respect to each other and with respect to the lateral portions 28 of the peripheral wire. Each formed wire spring 42 has oppositely opening loops including torsion bars 44 and generally straight connecting portions 46 extending between the torsion bars. Distal end torsion bars 48 of each spring 42 are secured by clips 50 to the longitudinal portions 26 of the peripheral wire in order to provide cooperation therebetweeen that results in the increased firmness of the load supporting surface on the mattress with which the panel is utilized. Bends 52 of the distal torsion bars 48 ensure retention thereof by the clips 50. Also, it should be noted that the lengths of the straight connecting portions 46 can be varied as may be desired in order to control the longitudinal positons at which the torsional deflection of bars 44 takes place.

Auxiliary panel 12 illustrated in FIG. 6 includes torsion bar springs 42 of the formed wire type extending laterally between the lateral portions 28 of the peripheral wire 24 in a longitudinally spaced relationship with respect to each other and with respect to the longitudinal portions 26 of the peripheral wire. Torsion bars 44 and connecting portions 46 of the springs define oppositely opening loops in the same manner as the embodiment of FIG. 5. Distal end torsion bars 48 of these springs 42 are secured to the lateral portions 28 of the peripheral wire 24 at appropriate longitudinal positions so as to provide increased firmness along the longitudinal extent of the load supporting surface with which the panel is utilized. Thus, the springs 42 may be located longitudinally with respect to the mattress at appropriate locations to provide increased support at the shoulder or buttocks areas of the sleeper or may be arranged in alignment with a row of coil springs, etc.

With each of the embodiments described, the peripheral wire 24 thereof may be either bare or covered with paper or plastic etc. in a conventional manner.

While the best modes for practicing the present invention have herein been described in detail, those familiar with the art to which this invention relates will recognize various alternative designs and embodiments for practicing the invention as defined by the following claims.

What is claimed is:

1. In a bedding unit including a plurality of springs defining a load supporting surface and a generally rectangular border wire supported by the springs and defining longitudinal and lateral margins of the load supporting surface, an auxiliary panel comprising: a peripheral wire of a generally rectangular shape on the load supporting surface; said peripheral wire having opposite longitudinal portions and opposite lateral portions respectively extending parallel to the longitudinal and lateral margins defined by the border wire; said longitudinal portions of the peripheral wire being spaced longitudinally inward from the longitudinal margins defined by the border wire; a plurality of torsion bar springs extending between opposite portions of the peripheral wire; each torsion bar spring having oppositely opening loops including torsion bars and connecting portions extending between the torsion bars; and each torsion bar spring including distal end torsion bars adjacent which the torsion bar spring terminates and said end torsion bars being connected to the peripheral wire such that the auxiliary panel provides increased firmness to the load supporting surface.

2. A bedding unit as in claim 1 wherein the torsion bar springs are of the sinuous type including curved connecting portions extending between the torsion bars.

3. A bedding unit as in claim 1 wherein the torsion bar springs are of the formed wire type including generally straight connecting portions extending between the torsion bars.

4. A bedding unit as in claims 1, 2, or 3 which includes two load supporting surfaces and two of the auxiliary panels for respectively providing firmness to the two load supporting surfaces.

5. In a bedding unit including a plurality of springs defining a load supporting surface and a generally rectangular border wire supported by the springs and defining longitudinal and lateral margins of the load supporting surface, an auxiliary panel comprising: a peripheral wire of a generally rectangular shape on the load supporting surface; said peripheral wire having opposite longitudinal portions and opposite lateral portions respectively spaced longitudinally and laterally inward from the longitudinal and lateral margins defined by the border wire in a parallel extending relationship thereto; a plurality of torsion bar springs of the sinuous wire type extending between the longitudinal portions of the peripheral wire; each torsion bar spring having oppositely opening loops including torsion bars and curved connecting portions extending between the torsion bars; and each torsion bar spring including distal end torsion bars adjacent which the torsion bar spring terminates and said end torsion bars being connected to the longitudinal portions of the peripheral wire such that the auxiliary panel provides increased firmness to the load supporting surface.

6. In a bedding unit including a plurality of springs defining a load supporting surface and a generally rectangular border wire supported by the springs and defining longitudinal and lateral margins of the load supporting surface, an auxiliary panel comprising: a peripheral wire of a generally rectangular shape on the load supporting surface; said peripheral wire having opposite longitudinal portions and opposite lateral portions respectively spaced longitudinally and laterally inward from the longitudinal and lateral margins defined by the border wire in a parallel extending relationship thereto; a plurality of torsion bar springs of the sinuous wire type extending between the lateral portions of the peripheral wire; each torsion bar spring having oppositely opening loops including torsion bars and curved connecting portions extending between the torsion bars; and each torsion bar spring including distal end torsion bars adjacent which the torsion bar spring terminates and said end torsion bars being connected to the lateral portions of the peripheral wire at longitudinal positions therealong such that the auxiliary panel provides increased firmness to the load supporting surface as desired along the longitudinal extent of the unit.

7. In a bedding unit including a plurality of springs defining a load supporting surface and a generally rectangular border wire supported by the springs and defining longitudinal and lateral margins of the load supporting surface, an auxiliary panel comprising: a peripheral wire of a generally rectangular shape on the load supporting surface; said peripheral wire having opposite longitudinal portions and opposite lateral portions respectively spaced longitudinally and laterally inward from the longitudinal and lateral margins defined by the border wire in a parallel extending relationship thereto; a plurality of torsion bar springs of the formed wire type extending between the longitudinal portions of the peripheral wire; each torsion wire bar spring having oppositely opening loops including torsion bars and generally straight connecting portions extending between the torsion bars; and each torsion bar spring including distal end torsion bars adjacent which the torsion bar spring terminates and said end torsion bars being connected to the longitudinal portions of the peripheral wire such that the auxiliary panel provides increased firmness to the load suppporting surface.

8. In a bedding unit including a plurality of springs defining a load supporting surface and a generally rectangular border wire supported by the springs and defining longitudinal and lateral margins of the load supporting surface, an auxiliary panel comprising: a peripheral wire of a generally rectangular shape on the load supporting surface; said peripheral wire having opposite longitudinal portions and opposite lateral portions respectively spaced longitudinally and laterally inward from the longitudinal and lateral margins defined by the border wire in a parallel extending relationship thereto; a plurality of torsion bar springs of the formed wire type extending between the lateral portions of the peripheral wire; each torsion bar spring having oppositely opening loops including torsion bars and generally straight connecting portions extending between the torsion bars; and each torsion bar spring including distal end torsion bars adjacent which the torsion bar spring terminates and said end torsion bars being connected to the lateral portions of the peripheral wire at longitudinal positions therealong such that the auxiliary panel provides increased firmness to the load supporting surface as desired along the longitudinal extent of the unit.

* * * * *

UNITED STATES PATENT AND TRADEMARK OFFICE

CERTIFICATE OF CORRECTION

PATENT NO. : 4,348,014

DATED : September 7, 1982

INVENTOR(S) : Stanley Litkewycz

It is certified that error appears in the above—identified patent and that said Letters Patent is hereby corrected as shown below:

Column 4, line 32 (Spec. page 8, line 21), after the word "bend" insert --40--.

Column 7, line 10, delete "wire", line 18, delete "suppporting" and insert --supporting--.

Signed and Sealed this

*Fifteenth* Day of *February 1983*

[SEAL]

*Attest:*

GERALD J. MOSSINGHOFF

*Commissioner of Patents and Trademarks*

*Attesting Officer*